United States Patent [19]

Umeda et al.

[11] Patent Number: 4,686,946

[45] Date of Patent: Aug. 18, 1987

[54] VALVE MOVING SYSTEM OF AN OVERHEAD VALVE ENGINE

[75] Inventors: Tatsutoshi Umeda; Yoshio Tani; Takeshi Kaai; Keiichi Nakano; Yoshio Izui, all of Osaka, Japan

[73] Assignee: Kubota Limited, Osaka, Japan

[21] Appl. No.: 858,831

[22] Filed: Apr. 29, 1986

Related U.S. Application Data

[63] Continuation of Ser. No. 704,956, Feb. 25, 1985, abandoned.

[30] Foreign Application Priority Data

Apr. 27, 1984 [JP] Japan ..... 59-63684[U]
May 25, 1984 [JP] Japan ..... 59-107071

[51] Int. Cl.[4] ..... F01L 1/12; F01M 9/10

[52] U.S. Cl. ..... 123/90.41; 123/90.38; 123/572

[58] Field of Search ..... 123/90.39, 90.41, 90.4, 123/90.38, 572, 574

[56] References Cited

U.S. PATENT DOCUMENTS

| | | | |
|---|---|---|---|
| 1,442,995 | 1/1923 | Belden | 123/90.39 |
| 2,976,862 | 3/1961 | Allen | 123/90.39 |
| 3,064,635 | 11/1962 | Rohrbacher | 123/90.41 |
| 3,142,357 | 7/1964 | Thompson | 123/90.41 |
| 3,289,657 | 12/1966 | Winter | 123/90.41 |
| 3,301,238 | 1/1967 | Hanley | 123/90.41 |
| 3,313,281 | 4/1967 | Schneider | 123/572 |
| 3,430,612 | 3/1969 | Ansteth | 123/90.38 |
| 3,667,434 | 6/1972 | Sandusky | 123/90.41 |
| 3,754,539 | 8/1973 | Bandimere | 123/90.41 |
| 4,337,738 | 7/1982 | Bubniak et al. | 123/90.41 |

FOREIGN PATENT DOCUMENTS

| | | | |
|---|---|---|---|
| 1168164 | 4/1964 | Fed. Rep. of Germany | 123/90.41 |
| 357835 | 1/1906 | France | 123/90.39 |

*Primary Examiner*—Ira S. Lazarus
*Attorney, Agent, or Firm*—Schwartz, Jeffery, Schwaab, Mack, Blumenthal & Evans

[57] ABSTRACT

The present invention relates to a valve moving system of an over head valve engine, minimized the overall height of cylinder head and head cover by inclining valve stems and footing bolts of rocker arm supports, and by disposing the part of upper wall of the cylinder head, where said footing bolts are screwed in, lower than bosses for supporting valve stems, which are also formed on said upper wall of said cylinder head, so as to match said engine with any machines which have a side valve engine for general use.

8 Claims, 5 Drawing Figures

VALVE MOVING SYSTEM OF AN OVERHEAD VALVE ENGINE

This application is a continuation of application Ser. No. 704,956, filed Feb. 25, 1985, now abandoned.

BACKGROUND OF THE INVENTION

1. Field of the Invention

The present invention relates to a valve moving system of an over head valve engine, comprising a rocker arm chamber disposed between the cylinder head and head cover, a pair of rocker arms located in the rocker arm chamber, one rocker arm co-operating with an inlet valve and the corresponding push rod and another rocker arm co-operating with an exhaust valve and the corresponding push rod and, a pair of footing bolts of the rocker arms support of the knuckle type for supporting a rocker arm.

2. Prior Art

Almost all engines for general use, which are mounted with a fuel tank thereupon, have been employed side valve engines take a serious view of manufacturing cost.

However, a tendency that side valve engines are being taken over by over head valve engines take a more serious view of running cost has been found recently in this art.

In this trend, the serious problem to be solved is matching the engine with various machines. Indeed, the fact that the height of the over head valve engine is higher than that of the side valve engine is well known.

Therefore, it has become desirable to make the height of the over head valve engine as small as that of the side valve engine. To this end, on the one hand, the bottom of the fuel tank is recessed upwardly to locate the tank lower by housing the engine head in the recess, and on the other hand, the importance of attempts to decrease the total height of the cylinder head is increasing.

However, the known over head valve engine comprises intake and exhaust valves having stems standing vertically, and rocker arm supports of the knuckle type for simplifying the operating mechanism. In this practice, the stems are extruded from the upper wall of the cylinder head, and the tops of the footing bolt of the rocker arm supports are further extruded upwardly from them. Therefore, the head cover should be made in a deep box, and the overall height of the engine should be high at the depth of the head cover. The overall height of the engine mounted with a fuel tank thereupon is still taller, so that the it may depart from the scope of the recent requirement for minimization of the size of the engine in this art.

Moreover, the over head valve engine of known type is provided with a breather within the head cover. However, the location of the breather is limited to a small space which is formed between a vertical side wall of the head cover and the rocker arms. The width of the breather is also limited within the space between a pair of rocker arms. Therefore, the length of the path available in the cavity of the breather for blow-by gas induced therein is limited shorter, and the performance of the breather is not superior.

SUMMARY OF THE INVENTION

Therefore, the first object of the present invention is to minimize the overall height of the engine by minimizing the depth of the head cover.

In order to attain this first object, the valve moving system according to the present invention comprises stems of inlet and exhaust valves inclined to aproach the push rods at their tops, as well as the footing bolts of rocker arm supports, and the part of cylinder head, in which these footing bolts are screwed, and which is located lower than the bosses which are formed at the upper wall of the cylinder head for supporting the valve stems therethrough.

The upper wall of the cylinder head may be preferably declined from the bosses to the part where the footing bolts are screwed in.

The second object of the present invention is to improve the performance of the breather by attaining a larger space for it in the head cover.

To this end, the valve moving system according to the present invention is provided with a side wall of the cylinder head, inclined to the lateral out side of the push rods, a head cover shaped like an inverted bowl, and a breather located in the space expanded to the lateral out side of the push rods within the rocker arm chamber.

BRIEF DESCRIPTION OF THE DRAWINGS

The objects other than described above of the present invention would be clarified and understood more clearly by reading the detailed description of a preferred embodiment of the present invention described below with reference to the attached drawings, wherein.

DETAILED DESCRIPTION OF THE PREFERRED EMBODIMENT

Figure 1:
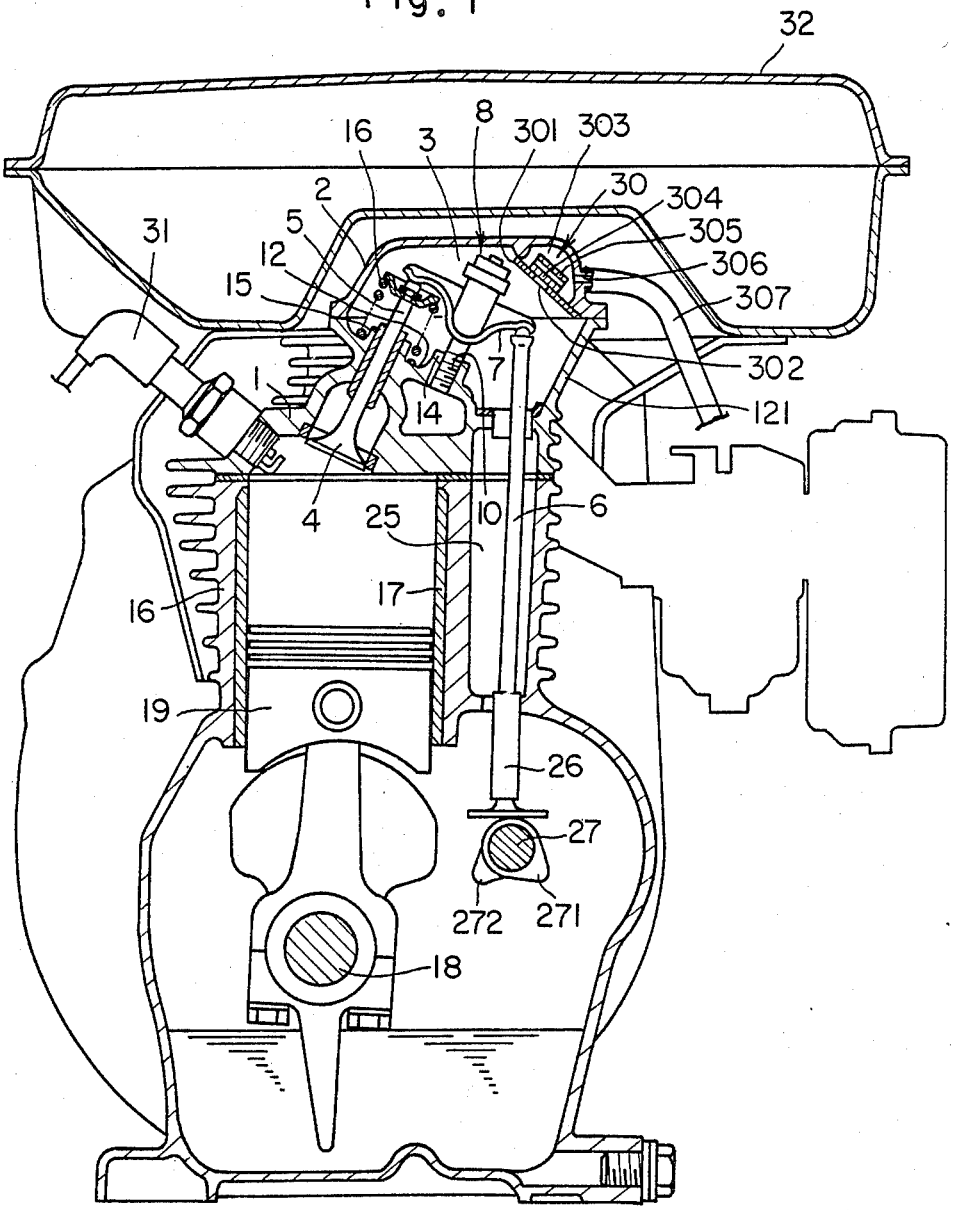
FIG. 1 is a central vertical section of the air cooling vertical engine according to the present invention.

As shown in FIG. 1, the air cooling over head valve engine shown, is provided with a cylinder block 16, a cylinder head 1 assembled with the cylinder block 16, a cylinder 17 disposed at the central part of the cylinder block 16, and a piston inserted slidable up and down in the cylinder 17 and linked with the crank shaft 18.

Figure 2:
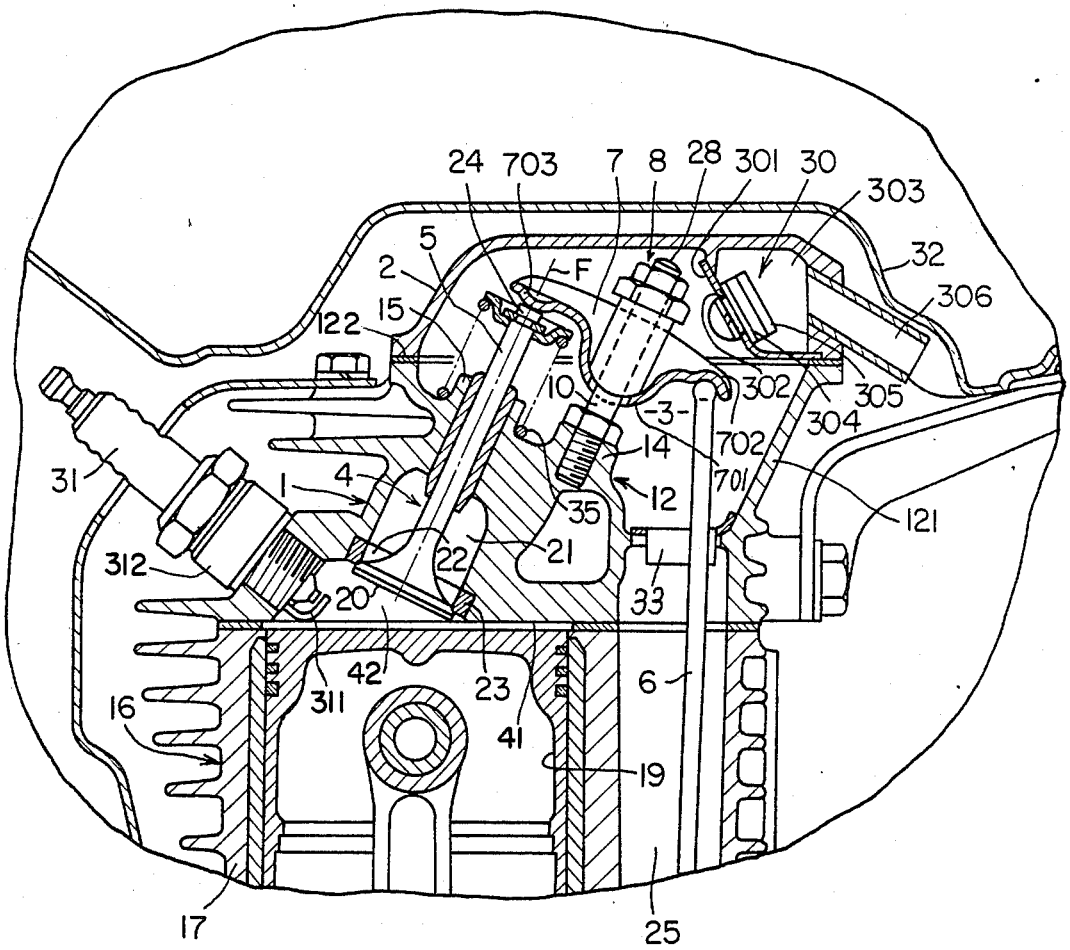
FIG. 2 is a fragmentary section around the rocker arm chamber of the engine.

Referring to FIG. 2, a head cover 2 is removably fixed on the cylinder head 1, and a rocker arm chamber 3 is formed between them. A pair of extruded bosses 15 are formed on the upper wall 12 of the cylinder head 1 at the front and rear sides of the left half thereof. The stems 5 of the inlet and outlet valves 4 are slidably supported by the bosses 15, penetrating them respectively. The head 20 of valves 4 are arranged to open and shut the inlet and exhaust ports 21 at their opening 22 in the cylinder chamber, and biased to contact valve seats 23 by springs 35 for shutting ports 21.

Another pair of bosses 14 are extruded on the upper wall 12 of the cylinder head 1 at the front and rear sides of the right half thereof. The footing bolts 10 of rocker arm supports 8 of the knuckle type are screwed into these bosses 14.

Each rocker arm support 8 is arranged oscillatably receive a rocker arm 7 shaped like a boat at the middle part 701, and is received by one of the push rods 6 at the input end 702, and by the top stem end 24 of inlet or exhaust valve 4 at the outlet end 703.

Moreover, these push rods 6 are passed freely through a passage 25 formed through the cylinder block 16 and cylinder head 1 for returning oil, and received at the lowest end by tappet 26 which is in contact with a cam shaft 27 driven by the crank shaft 18.

Valve stems 5 are inclined to approach the push rods 6 at their tops 24, as well as the footing bolts 10 of rocker arm supports 8, and the bosses 14 in which these footing bolts are screwed is located lower than the bosses 15 for supporting valve stems 5 which are penetrating therethrough.

By the inclination of the valve stems 5 and footing bolts 10, the apparent height of them extruding over the upper wall 12 of the cylinder head 1 is decreased, and the depth of the head cover 2 may be minimized. Moreover, as the bosses 14 are located lower than the other bosses 15, the height of the top of the footing bolts 10 is further lowered and the depth of the head cover 2 may be minimized further.

Figure 3:
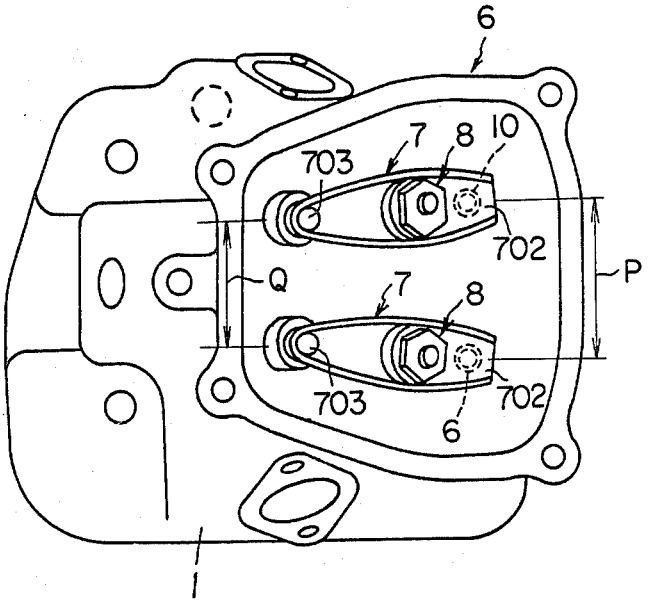
FIG. 3 is a plan view of the cylinder head and the rocker arms of the engine.
Figure 4:
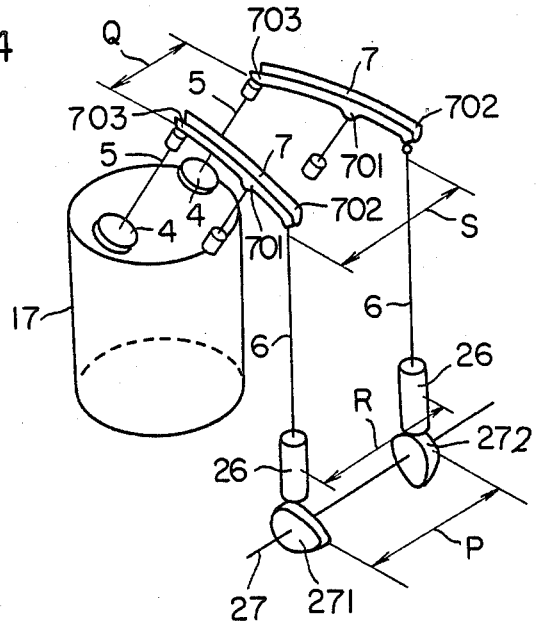
FIG. 4 is a schematic drawing of the valve moving system of the engine present invention.

The distance Q, shown in FIGS. 3 and 4, between the valves 4 is made small, so as to attain high a compression ratio by minimizing the volume of the combustion chamber. But, the distance P between cams 271 and 272 is made larger to in accordance with that of a side valves engine, so that the cam shaft 27 may be common with a side valve engine, and that the passage 25 may be machined by the same special purpose machine tool.

The distance S shown in FIG. 4 between the top ends of push rods 6 is the same to the distance P between cams 271 and 272, so as to locate each push rod 6 in the vertical plane on which the corresponding cam 271 or 272 rotates. The upper part of each push rod 6 is guided by a guide slit 33 to keep it in its position. Thus, the lateral swing of the rocker arm 7 is eliminated and the extraordinary defacements of valve stems 5, rocker arms 7 and top ends of push rods 6 are prevented.

Figure 5:
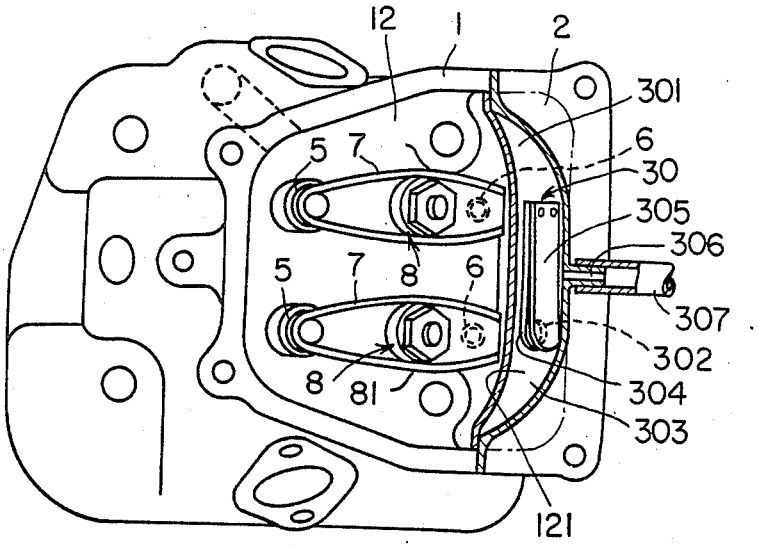
FIG. 5 is a partially sectioned plan view of the cylinder head of the engine.

As shown in FIG. 5, the side wall 121 of the cylinder head 1 is inclined to the lateral out side of the push rods 6, and the head cover 2 is shaped like an inverted bowl. The rocker arm 7 is provided inclined at the push rod side 6. The height adjustable nut of rocker arm support 8, of the rocker arm 7, is twistly fixed with the upper part of support bolt 10 and is situated at a height that positions it close to the side terminal portion of the related valve of the rocker arm 7, just above the upper face of rocker arm 7. The upper wall of the head cover 2 is positioned just above support bolt 10 and the height adjustable nut. Under the inverted bowl-shaped head cover 2, a broad space remains between the inner side of the upper side portion of the inclined side wall portion of the cylinder head and the outer side of the height adjustable nut. The side terminal portion of the related push rod part of rocker arm 7, and the breather 30 can then be mounted in this broad space. The breather 30 is located in the upper corner of the space expanded to the lateral out side of the push rods 6 within the rocker arm cover 2.

The breather 30 is provided with a separation wall 301 which defines a breather chamber 303 in the rocker arm chamber 3, an inlet 302 opened through the separation wall 301 near to 6, a lead valve 304 for opening and closing the inlet 302, a valve check 305, an outlet 306 formed through the side wall of head cover 2, and a lead out pipe 307 one end of which communicates with the outlet 306 and another end is in communication with atmosphere or clean room of an air cleaner.

Blow-by gas is introduced from a crank room through the passage 25, rocker arm chamber 3 and inlet 302 into the breather chamber 303. The misty oil involved in blow-by gas may be separated by the lead valve and left in the rocker arm chamber 3. Blow-by gas separated oil component may be exhausted out of the breather chamber 303 through the outlet 306.

It is notable that the breather 30 is located at the upper part of the space expanded to the lateral out side of the push rods 6 within the rocker arm cover 2. As seen in FIG. 4, the space where the breather occupies is not limited by rocker arms 6 in width, and the longer distance is available between the inlet 302 and outlet 306. Therefore, the minute oil mist involved in blow-by gas may be finely separated in the chamber 303. Thus, superior performance of breather 30 is available.

In FIGS. 1 and 2, a spark plug 31 is screwed through the other side of the cylinder head 1, and a fuel tank 32 mounted on the engine has a recess for housing head cover 2 therein.

Referring to FIG. 2, a flat cavity 41 is formed at the lower portion of the cylinder head. A combustion chamber 42 is formed atop cavity 41. A discharge electrode 311 of an igniting plug 31 is disposed next to the combustion chamber 42, as shown. The main body 312 of the igniting plug 31 projects outwardly from the cylinder head 1. The stem 5 of inlet and outlet valve 4 is angled toward push rod 6.

Inlet and outlet ports 21 are formed in the cylinder head 1 and are positioned above the central portion of cylinder block 16, as shown. The side wall 121 of the rocker arm chamber 3 is of a sufficient height such that the upper surface of 122 of the rocker arm chamber 3 is positioned above the upper wall 12 of the cylinder head 1.

It will be readily understood that the present invention is not limited to the preferred embodiment but includes all such modifications and variations within the spirit and scope of the invention claimed as would be obvious to those skilled in the art.

What is claimed is:

1. An air-cooled overhead valve engine comprising:

a cylinder head;

a cylinder head cover removably attached to said cylinder head;

an inlet valve;

an exhaust valve;

first and second push rods;

a rocker arm chamber formed between said cylinder head and said cylinder head cover;

first and second rocker arms having a tapered shape disposed in said rocker arm chamber, wherein said first rocker arm is coupled to said inlet valve and an upper end of said first push rod, and said second rocker arm is coupled to said exhaust valve and an upper end of said second push rod, wherein said inlet valve and said exhaust valve are inclined toward said upper end of said first and second push rods, and said push rods being disposed a distance from one another which is greater than a second distance between said valves, a pair of cams operatively connected to said push rods, a third distance between said cams being equal to the distance between said push rods;

first and second knuckle type footing bolt means for supporting said first and second rocker arms, respectively;

a pair of bosses for receiving a stem portion of said inlet and exhaust valve, said bosses being disposed above said footing bolts;

a breather, disposed under said cylinder head cover and positioned laterally outside of said push rods within said rocker arm chamber;

a combustion chamber disposed below said inlet and exhaust valve; and an ignition plug having a discharge electrode and a main body, said discharge electrode being disposed above said combustion chamber and opposite one of said push rods, and said main body projecting outwardly from said cylinder head.

2. The air-cooled overhead valve engine of claim 1, wherein said inlet and exhaust valves are positioned above a portion of said combustion chamber closest to said push rod, said engine further comprising inlet and outlet ports formed in an upper surface of said cylinder for receiving said inlet and exhaust valves, said ports being disposed substantially centrally on said upper surface of said cylinder.

3. The air-cooled overhead valve engine of claim 1, wherein a side wall of said rocker arm chamber extends above the uppermost portion of said cylinder head.

4. The air-cooled overhead valve engine of claim 1 wherein said cams have a vertical plane and said push rods are located in said vertical plane.

5. An air-cooled overhead valve engine comprising:

(a) inlet and outlet valves, (b) a pair of push rods, (c) a pair of cams cooperating with said push rods, (d) a pair of rocker arms being at an angle to each other, said rocker arms being coupled to respective valves and push rods, said push rods being disposed at a distance from one another, which is greater than a second distance between said valves, and a third distance between said cams being equal to the distance between said push rods, (e) a combustion chamber disposed below said valves, (f) ignition means in said combustion chamber, (g) a cylinder head and a cylinder head cover thereover, (h) a rocker arm chamber formed between said cylinder head and said cylinder head cover, (i) a breather disposed under said cylinder head cover and positioned laterally outside of said push rods within said rocker arm chamber, and wherein said rocker arms are disposed in said rocker arm chamber.

6. The engine of claim 5 including first and second knuckle type footing bolt means for supporting said rocker arms, a pair of bosses for receiving a stem portion of each of said valves, said bosses being disposed above said footing bolts.

7. The engine of claim 5 wherein said cams have a vertical plane and said push rods are located in said vertical plane.

8. A valve moving system for an overhead valve engine comprising:

first and second push rods;

a cylinder head including an upper wall, a side wall positioned laterally outside said push rods and a section for receiving footing bolts;

a cylinder head cover removably attached to said cylinder head and being shaped convexly;

an inlet valve;

a breather;

an exhaust valve;

a rocker arm chamber formed between said cylinder head and said cylinder head cover;

first and second rocker arms disposed within said rocker arm chamber, said first rocker arm being coupled to said inlet valve and an upper end of said first push rod, and said second rocker arm is coupled to said exhaust valve and an upper end of said second push rod, and said inlet valve and said exhaust valve are inclined toward said upper end of said first and second push rods;

first and second rocker arm supports including knuckle type footing bolt means for supporting said first and second rocker arms, respectively;

a pair of bosses for receiving a stem portion of said inlet and exhaust valves, said bosses being disposed above said footing bolts; and wherein said breather is disposed under said valve head cover and positioned between said cylinder head side wall and said cylinder head cover.

* * * * *